United States Patent [19]

Shorter, Jr.

[11] 4,263,865

[45] Apr. 28, 1981

[54] UTILITY DISTRIBUTION SYSTEM FOR FLOATING UNITS

[76] Inventor: Myron L. Shorter, Jr., 834 Vallejo Ave., Novato, Calif. 94947

[21] Appl. No.: 921,705

[22] Filed: Jul. 3, 1978

[51] Int. Cl.[3] ..... B63B 35/38

[52] U.S. Cl. ..... 114/267; 114/266

[58] Field of Search ..... 114/266, 267, 263; 405/218, 219

[56] References Cited

U.S. PATENT DOCUMENTS

| | | | |
|---|---|---|---|
| 3,073,274 | 1/1963 | Lamb | 114/266 |
| 3,191,565 | 6/1965 | Filak | 114/266 |
| 3,442,238 | 5/1969 | Van Oost | 114/263 |
| 3,659,540 | 5/1972 | Toby et al. | 114/266 |
| 3,967,569 | 7/1976 | Shorter, Jr. | 114/266 |

*Primary Examiner*—Sherman D. Basinger

*Attorney, Agent, or Firm*—Bielen and Peterson

[57] ABSTRACT

A utility distribution system for a floating unit having a core and an envelope with a top portion utilizing a trench extending along a dimension of the top portion of the floating unit. The trench is formed by a wall being part of the envelope of the float unit. The system also includes means for permitting ingress to and egress from the trench for at least one utility conduit. The system also includes means for supporting the wall of the trench.

8 Claims, 7 Drawing Figures

FIG-2
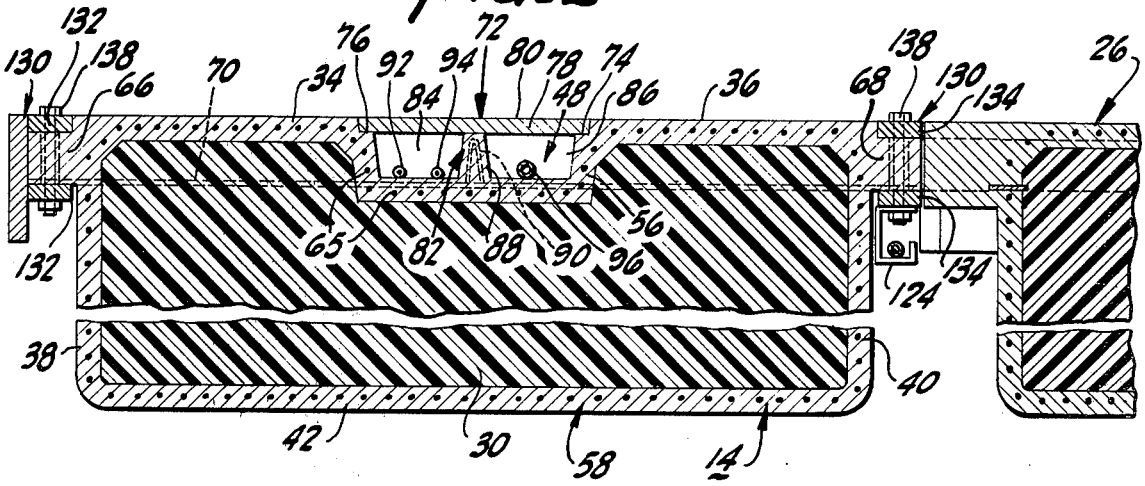
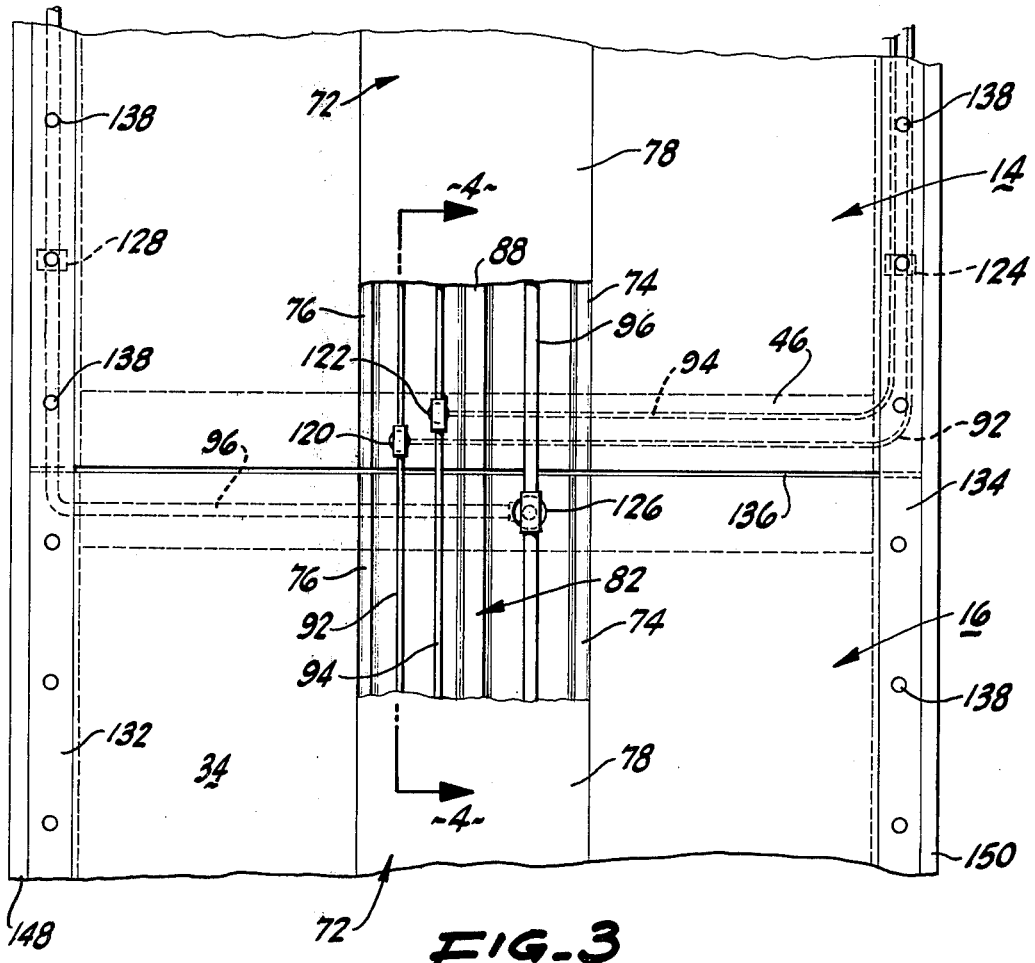
FIG-3

UTILITY DISTRIBUTION SYSTEM FOR FLOATING UNITS

BACKGROUND OF THE INVENTION

The present invention relates to a novel utility distribution system for floating units.

Floating units which are used in marina construction generally include those of a type having a core and an envelope with a top portion forming an upper surface, two sides, two ends, and a bottom portion. It has been difficult in the past to provide utility service to boats moored at such marinas. Typically, utility service has been run along the sides of floating units by using hangers or other means for suspending the utility conduits above the water level. Unfortunately, the utility conduits are exposed to collision with boats being moored thereto. This is especially true between floating units which are interconnected to form a walkway and the like. Prior construction of conduit distribution systems makes it difficult to service faulty or broken conduits since they are normally inaccessible to workmen standing on the top portion of the float unit. In addition, prior utility distribution systems are makeshift in nature, requiring changes to the basic construction of a particular float unit.

There is generally a need for a utility distribution system which may be integrally formed with the float units forming a marina for mooring boats.

SUMMARY OF THE INVENTION

In accordance with the present invention, a novel and useful utility distribution system is provided. The utility distribution system of the present invention is usable with a float unit having a core and an envelope with a top portion, including an upper surface, two sides, two ends, and a bottom portion. The utility system includes a trench extending along a dimension of the top portion of the float unit. The trench is formed by a wall being part of the envelope of the float unit itself. The system also has means for permitting ingress to and egress from the trench of at least one utility conduit. In many situations plurality of float units may be included each having a trench and the ingress and egress means heretofore described.

Another apsect of the present invention includes means for supporting the wall of the trench to the envelope of the float unit itself.

The utility trench may be constructed with means for covering the trench in relation to the upper surface of the top portion of the float unit. Such covering means may be easily removable and serve as a walkway contiguous with the upper surface of the float unit. The utility trench may be divided into a plurality of sections along the dimension of the top portion of the float unit. In one particular construction the dividing means for the trench may serve also to support the covering means for the trench.

In those float units which have flanges along both sides the trench wall supporting means may include a member connected to the flanges and spanning the same.

The invention may include a provision of two float units in end to end abutment, each float having a pair of flanges along both sides. Interconnecting means between both float units may embrace a pair of stringers extending on opposite sides of each of the flanges and across the point of abutment between the first and second float units. This interconnecting means may also have fastening means in the form of vertical members extending through each flange and associated stringers. By this expedient the stringers and flanges are held in compression. Likewise the spanning member used to support the wall of the utility trench may be held in compression by the fastening means.

The utility distribution system of the present invention may be used on your piers extending off a main pier in a marina. The trench of the utility system may be cast directly into the float unit upon initial construction of the same.

It may be seen that a novel and useful utility distribution system for floating units has been described.

It is therefore an object of the present invention to provide the utility distribution system for floating units which protect utility conduits from destructive collision with boats being moored thereto.

It is another object of the present invention to provide utility distribution system for floating units which permits easy access to the utility conduits for installation, maintenance, and repair of the same. It is yet another object of the present invention to provide a utility distribution system for floating units which may be adapted to installation in end to end or side to end abutment of the floating units. It is yet another object of the present invention to provide a utility distribution system for floating units which may be constructed the same time the float unit is constructed and compatible therewith.

The invention possesses other objects and advantages, especially as concerns particular features and characteristics thereof, which will become apparent as the specification continues.

BRIEF DESCRIPTION OF THE DRAWINGS

FIG. 2 is a view taken along line 2—2 of FIG. 1.

FIG. 3 is a partially broken top plan view of the interconnection between two floating units.

DESCRIPTION OF THE PREFERRED EMBODIMENTS

Figure 1:
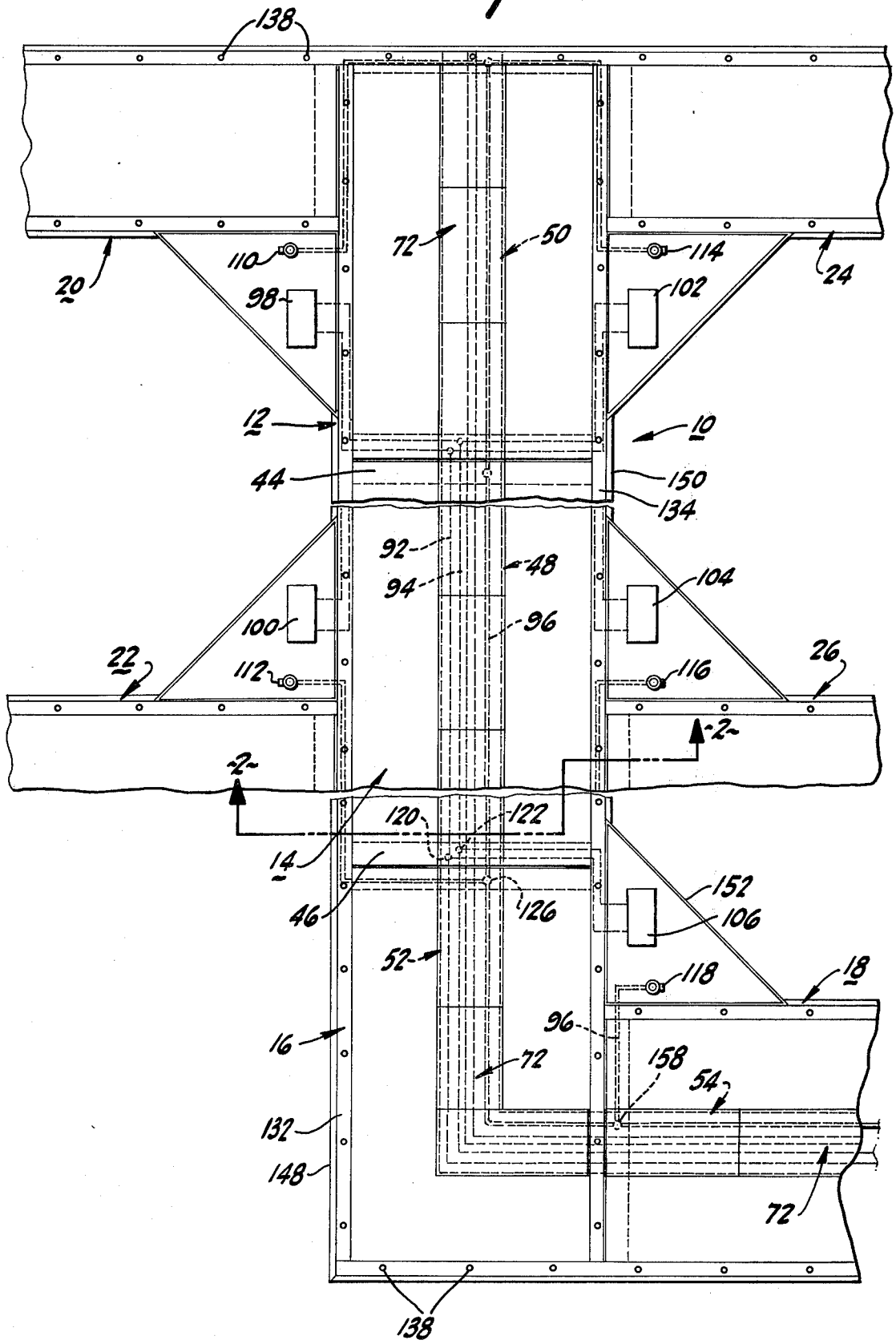
FIG. 1 is a partially broken top plan view of a floating dock having a plurality of float units.

The invention as a whole is shown in the drawings as designated by reference character 10, FIG. 1. As shown in FIG. 1 a typical marina includes float units 12, 14, 16 and 18 forming a walkway with finger piers 20, 22, 24 and 26 forming the extensions thereto.

Briefly turning to FIG. 2. each float unit, such as float unit 14, typically includes a core 30 which is either hollow or filled with foamlike material 32 as shown. Float unit 14 has a top portion 34, including upper surface 36, two sides 38 and 40 and a bottom portion 42. The float unit 14 also has as one of its elements end portions 44 and 46, FIG. 1.

A trench 48 extends along a dimension of top portion 34 of float unit 14. As shown in the drawings trench 48 extends along the length of float unit 14 between end portions 44 and 46. As may be seen, float units 12, 14, 16, and 18 also include trenches 50, 52, and 54, FIG. 1. Trenches 48, 50, 52, and 54 align with each other as will be hereinafter discussed. Trench 48, typical of the remaining trenches, is formed by wall 56 which is an integral part of envelope 58.

Figure 4:
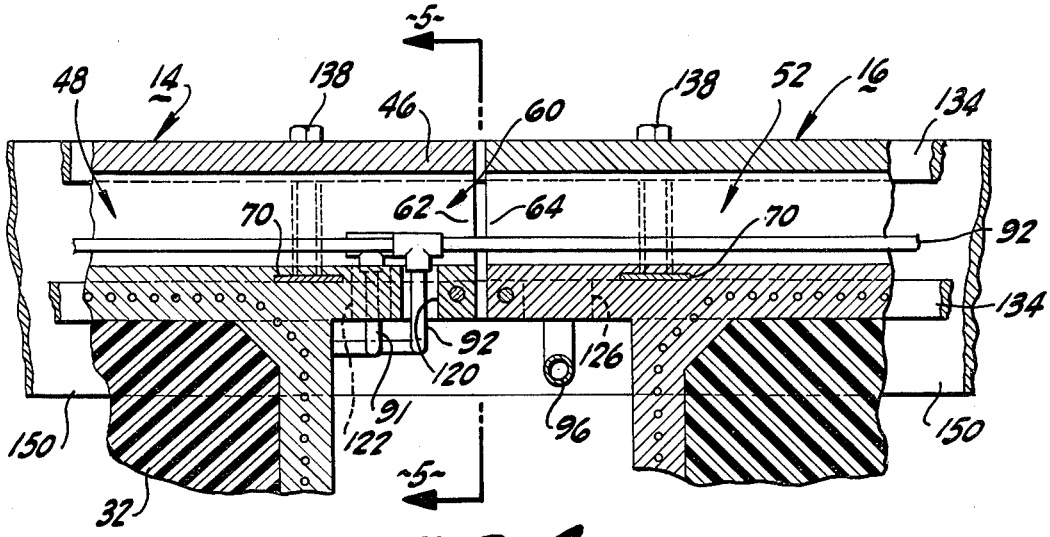
FIG. 4 is a view taken along line 4—4 of FIG. 3.

The utility system of the present invention also includes means 60 for permitting ingress to and egress from trench 48 of float unit 14. As shown in FIG. 4, means 60 consists of providing an opening 62 aligned with trench 48 of float unit 14. Likewise float unit 16 includes an opening 64. Thus, means 60 permits communication between trenches 48 and 52 of float units 14 and 16. It should be apparent that end portion 48 of float unit 14 also includes an opening (not shown) similar to opening 62 on end portion 46 thereof.

Wall 56 has means 65 for supporting the same to the envelope 58. As shown in the preferred embodiment, FIG. 2, welded wire mesh is cast into envelope 58 including wall 56 concrete is used as a contruction material. Welded wire mesh may be formed of steel aluminum and the like. One embodiment of the invention provides that float unit 14 has flanges 66 and 68 along side portions 38 and 40 thereof. Member 70 spans flanges 66 and 68 and serves as reinforcement for the wall 56 forming trench 48.

The utility system also includes cover means 72 for enclosing the trenches in relation to the upper surface 36 of typical float unit 14. Again referring to typical float unit 14 illustrated on FIG. 2, it is shown that wall 56 has support means such as platforms 74 and 76 which generally extend along the length of trench 48. A slab 78 rests on platforms 74 and 76 and are supported thereby. The upper surface 80 of slab 78 lies flush with the upper surface 36 of float unit 14. A plurality of such slabs maybe placed along the length of float unit 14. Since electrical and plumbing codes imposed by certain governmental bodies require that electrical conduits be separated from plumbing conduits, the present invention includes means 82 for dividing trench 48 into a plurality of sections. As shown in FIG. 2, trench 48 has been divided into electrical section 84 and plumbing section 86. An upright member 88, which may be formed into wall 56, provides the desired division of trench 48 and offers support to slab 78. Upright member 88 may be reinforced with a rebar 90.

Electrical conduits 92 and 94 run within electrical section 84 of trench 48. Likewise, plumbing circuit 96 extends along plumbing section 86 of trench 48. Both sets of conduits extend from one float unit to the other. With reference to FIG. 3 it may seen that electrical conduits 92 and 94 and plumbing conduit 96 travel from float unit 14 to float unit 16.

Figure 5:
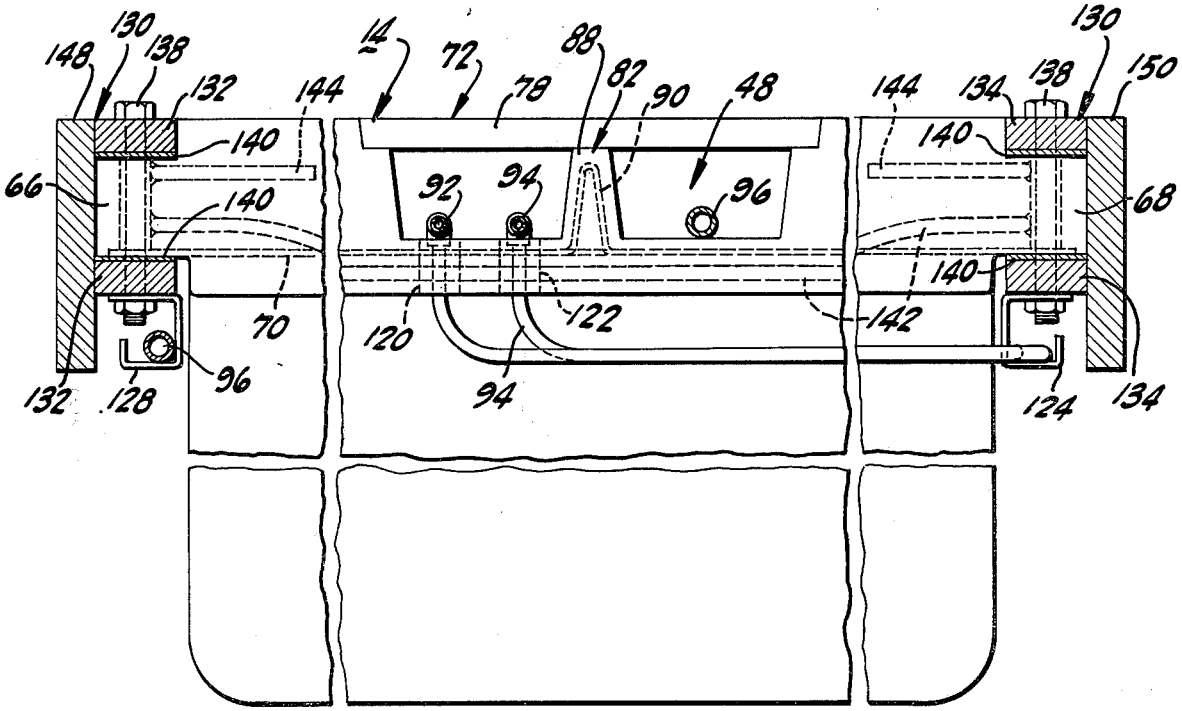
FIG. 5 is a view taken along line 5—5 of FIG. 4.

Returning to FIG. 1, it may be seen that electrical conduits 92 and 94 feed into a plurality of electrical boxes 98, 100, 102, 104 and 106. Likewise, plumbing conduit 96 services plumbing fixtures 110, 112, 114, 116, and 118, e.g. water faucets. FIG. 4 demonstrates the particular method of directing electrical conduits 92 and 94 from utility trench 48. Openings 120 and 122 through the lower part of end portion 46 permits electrical conduits 22 and 94 to drop there below. Electrical conduits 92 and 94 extend laterally in relation to the length of float unit 14 to bracket 124 and eventually to electrical box 106, FIGS. 1 and 5. In the same manner, plumbing conduit 96 passes down through opening 126 of float unit 16, to bracket 128, and finally to plumbing fixture 112. Thus finger pier 26 is provided with electricity and finger pier 22 is provided with water.

Float units 14 and 16 may be interconnected in end to end abutment with means 130 for interconnecting the same. References made to U.S. Pat. No. 3,967,569 which describes the interconnection means 130 implied by the preferred embodiment shown in the drawings. It includes a pair of stringers or whalers 132 which extend along the flange 66 on opposite sides thereof. In the same manner a pair of stringers 134 extend along flange 68 of float unit 14. With reference to FIG. 3, it may be seen that a pair of stringers 132 and 134 span the place of abutment between float units 14 and 16 i.e. in the vicinity of gap 136. Fastening means 138 extend through flanges 66 and 68, as well as the comparable flanges on float unit 16. It should be noted that element 140 which extends along flange 68 represents a plurality of such elements spaced along the flanges and associated pair of stringers for each of the float units which are located in end-to-end abutment. Brackets 124 and 128 as well as other brackets of like configuration are held by element 140. Similarly, spanning member 70 is securely held in compression between stringers 132 and 134 and flanges 66 and 68 by fastening means 138, FIG. 5. It should be noted that the float units may include other reinforcing elements such as rebar 142 and rebar 144. Fenders 148 and 150 may be easily fastened to stringers 132 and 134 by nailing.

Figure 6:
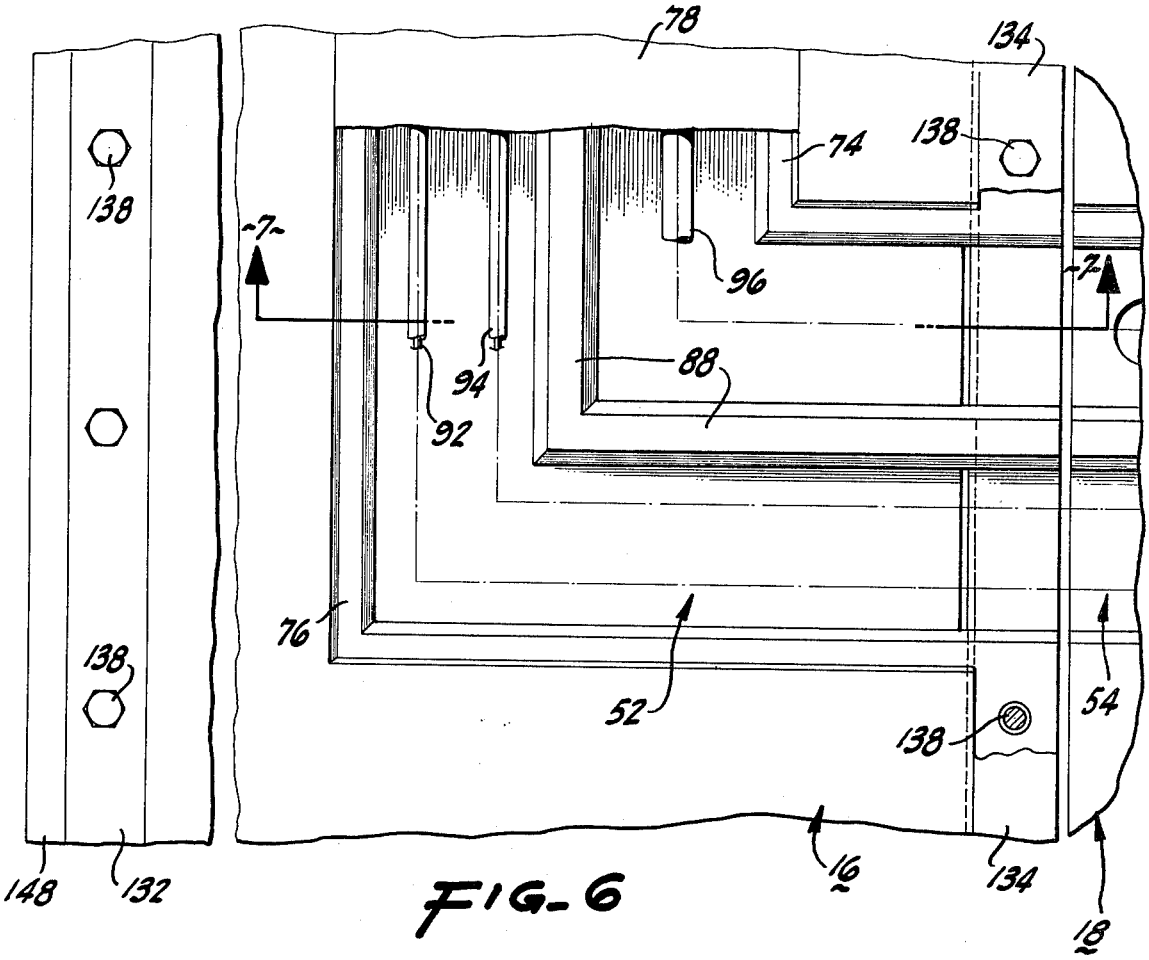
FIG. 6 is a partially broken top plan view showing the side to end interconnection of two float units.
Figure 7:
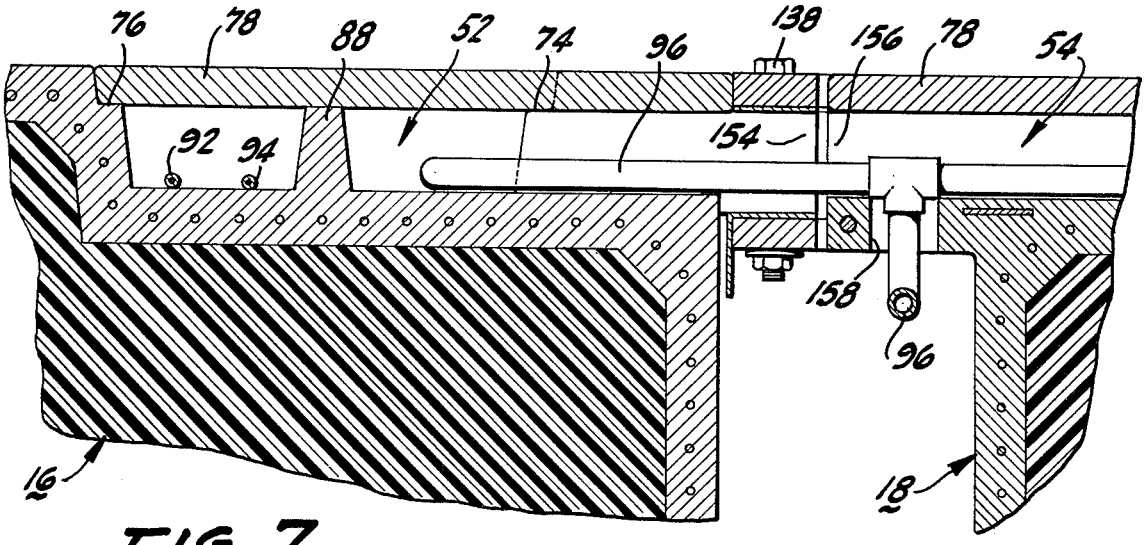
FIG. 7 is a view taken along line 7—7 of FIG. 6.

Turning to FIG. 6 a particular situation where the conduits must turn at an angle is shown. Specifically, the meeting of float units 16 and 18 is depicted. It should be noted that corner brace 152 is commonly used in marinas to support such side-to-end connection. Trench 52 turns at a right angle and passes into trench 54 through opening 154 and opening 156. As shown in FIG. 7, float unit 18 includes an opening 158 which permits plumbing conduit 96 to leave utility trench 54 for lateral extension to plumbing fixture 118.

In operation the float units 12, 14, 16 and 18, are placed in end to end abutment using fastening means 138. Finger piers 20, 22, 24, and 26 are placed in side to end abutment with the former float units. Float units 12, 14, 16, and 18, form a main walkway having utility trenches 48, 50, 52, and 54 below the upper surface of the main walkway float units. Covering means 72 protects the utility trenches and utility conduits 92, 94, and 96 therewithin. Electrical and plumbing service may be fed to finger piers by using openings which extend below trenches 48, 50, 52, and 54. Maintenance and repair of the utility conduits 92, 94 and 96 may be easily accomplished by removing sections of covering means 72. As shown in FIG. 1, uitility conduits 92, 94 and 96 extend to a shore supply found in the direction of the lower right hand corner of the drawing (not shown).

While in the foregoing specification embodiments of the invention have been set forth in considerable detail for the purposes of making a complete disclosure of the invention, it will be apparent to those of ordinary skill in the art that numerous changes may be made in such details without departing from the spirit and principles of the invention.

What is claimed is:

1. A utility distribution system for at least one float unit having a core and an envelope with a top portion, including an upper surface, two side portions, two end portions, and a bottom portion comprising:

a. a trench extending along a dimension of the top portion of the float unit, said trench formed by a wall being part of the envelope of the float unit;

b. means for permitting ingress to and egress from said trench of at least one utility conduit;

c. means for supporting said wall of said trench to the envelope of the float unit;

d. means for covering said trench in relation to the upper surface of the top portion of the float unit, said means for covering including a cover and support means formed at least in part by said envelope for supporting said cover over at least a portion of said trench, said cover support means including at least one platform forming a portion of said wall.

2. The utility distribution system of claim 1 which additionally comprises means for dividing said trench into a plurality of sections along said dimension of the top portion of the float unit.

3. The utility distribution system of claim 2 in which said means for dividing said trench also comprises a portion of said means for supporting said covering means for said trench.

4. The utility distribution system of claim 1 in which said at least one float unit includes a first and second float unit each having envelopes including flanges along both sides thereof, said float units being in end-to-end abutment and having means for interconnecting said float units comprising a pair of stringers extending on opposite sides of each of said flanges, said stringers spanning the place of abutment between said first and second float units, and fastening means, including elements extending through each of said flanges and associated stringers, for holding the same in compression.

5. The utility distribution system of claim 4 in which said trenches of said first and second float units include means for permitting the travel of the at least one utility conduit from said first float unit to said second float unit.

6. The utility distribution system of claim 4 in which said means for supporting said wall of said trench to the envelope of each of said first and second float units includes a member spanning said flanges on each float unit, said member spanning said flanges on each float unit being interposed said flanges and each pair of stringers associated with each flange thereof, said member spanning said flanges being held in compression by said fastening means.

7. The utility distribution system of claim 1 in which said trench includes at least one opening in the vicinity of an end portion of said at least one float unit to permit a utility conduit to travel downwardly from said trench.

8. The utility distribution system of claim 7 in which another float unit abuts a side portion of said at least one float unit.

* * * * *